US009390645B2

(12) United States Patent
Choi et al.

(10) Patent No.: US 9,390,645 B2
(45) Date of Patent: Jul. 12, 2016

(54) DISPLAY APPARATUS AND METHOD OF DRIVING THE SAME

(71) Applicant: Samsung Display Co., Ltd., Yongin, Gyeonggi-Do (KR)

(72) Inventors: Jae-Seok Choi, Uijeongbu-si (KR); Hoisik Moon, Asan-si (KR); Gwangho Nam, Asan-si (KR); Chang-Soo Lee, Suwon-si (KR); Min-Yup Chae, Chungcheongnam-do (KR); Hak-Mo Choi, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 0 days.

(21) Appl. No.: 14/450,130

(22) Filed: Aug. 1, 2014

(65) Prior Publication Data

US 2015/0187303 A1 Jul. 2, 2015

(30) Foreign Application Priority Data

Dec. 31, 2013 (KR) ..... 10-2013-0168025

(51) Int. Cl.
*G09G 1/00* (2006.01)
*G09G 3/20* (2006.01)

(52) U.S. Cl.
CPC ..... *G09G 3/20* (2013.01); *G09G 2320/0276* (2013.01); *G09G 2320/0285* (2013.01); *G09G 2320/0673* (2013.01); *G09G 2320/0693* (2013.01)

(58) Field of Classification Search
CPC ..... G09G 1/00; G09G 2230/00; G09G 5/00; H04N 9/646
See application file for complete search history.

(56) References Cited

U.S. PATENT DOCUMENTS

2007/0052643 A1* 3/2007 Li ..... G09G 3/2007 345/89
2007/0263127 A1* 11/2007 Fainstain ..... H04N 5/202 348/674
2011/0102478 A1 5/2011 Huang et al.
2015/0296193 A1* 10/2015 Cote ..... H04N 9/646 382/167

FOREIGN PATENT DOCUMENTS

JP 05-281942 A 10/1993
JP 2011-096265 A 5/2011
KR 10-0539941 B1 12/2005
KR 10-0963773 B1 6/2010
KR 10-1127843 B1 3/2012
KR 10-1362145 B1 2/2014

* cited by examiner

*Primary Examiner* — Michael Faragalla
(74) *Attorney, Agent, or Firm* — Innovation Counsel LLP

(57) ABSTRACT

A display apparatus is provided. The display apparatus includes a display panel including a plurality of display blocks; a driving circuit configured to control an image to be displayed on the display panel; and a timing controller configured to control the driving circuit in response to an image signal and a control signal and to provide a data signal to the driving circuit, wherein the timing controller comprises a memory storing gamma correction values corresponding to gray scales of the image signal, and wherein the timing controller outputs the data signal, and the data signal is obtained by correcting the image signal using the gamma correction values.

18 Claims, 9 Drawing Sheets

FIG. 4

230

| Gray Scale Values \ LUT# | LUT1 | LUT2 | · · · | LUTp |
|---|---|---|---|---|
| 0 | | | | |
| 1 | | | | |
| 2 | | | | |
| ⋮ | | | | |
| 100 | GM1 | GM2 | · · · | GMp |
| ⋮ | | | | |
| 254 | | | | |
| 255 | | | | |

300

FIG. 5A

231

| Gray Scale Values \ LUT# | LUT1 | LUT2 | · · · | LUTp |
|---|---|---|---|---|
| 0 | GMa | | | |
| 32 | GMb | | | |
| 64 | | | | |
| ⋮ | | | | |
| 192 | | | | |
| 224 | | | | |
| 255 | | | | |

310

FIG. 5B

232

| Gray Scale Values \ LUT# | LUT1 | LUT2 | · · · | LUTp |
|---|---|---|---|---|
| 0 | | | | |
| 16 | | | | |
| 32 | | | | |
| ⋮ | | | | |
| 224 | | | | |
| 240 | | | | |
| 255 | | | | |

320

FIG. 5C

233

| Gray Scale Values \ LUT# | LUT1 | LUT2 | · · · | LUTp |
|---|---|---|---|---|
| 0 | | | | |
| 8 | | | | |
| 16 | | | | |
| ⋮ | | | | |
| 240 | | | | |
| 248 | | | | |
| 255 | | | | |

330

DISPLAY APPARATUS AND METHOD OF DRIVING THE SAME

CROSS-REFERENCE TO RELATED APPLICATIONS

A claim for priority under 35 U.S.C. §119 is made to Korean Patent Application No. 10-2013-0168025 filed Dec. 31, 2013, in the Korean Intellectual Property Office, the entire contents of which are hereby incorporated by reference.

BACKGROUND (a) Technical Field

The present disclosure relates to a display apparatus and a method of driving the display apparatus. More particularly, the present disclosure relates to a display apparatus wherein a memory size can be reduced, and a method of driving the same.

(b) Description of the Related Art

Flat-screen display devices typically include liquid crystal display devices, field emission display devices, plasma display panel devices, organic light emitting display devices, and the like.

A flat-screen display device includes a display panel for displaying an image. A typical display panel includes a substrate, and is fabricated by performing a semiconductor process including a photo lithography process on the substrate. The photo lithography process may include exposure, development, and etching processes. In some instances, a brightness spot may occur on a completed substrate because of unevenness of a light exposure amount or introduction of foreign matter during the photo lithography process.

When the light exposure amount varies (such that the light exposure becomes uneven) during the photo lithography process, the parameters and dimensions of devices formed on the substrate may vary. For example, a size of an overlapping area between a gate and a drain of a thin film transistor, a spacer's height, parasitic capacitance between signal lines, etc. may vary depending on the degree of unevenness in the light exposure amount. The variations in device parameters and dimensions may subsequently cause differences in brightness on a display surface of the display panel. The brightness differences may appear as brightness spots (in the form of lines or dots).

The brightness spots affect image quality, and a display panel may be classified as an inferior product according to the level/number of brightness spots. As a result, brightness spots may lower manufacturing yield and product reliability.

SUMMARY

The present inventive concept addresses at least the above issues relating to brightness spots.

According to some embodiments of the inventive concept, a display apparatus is provided. The display apparatus includes a display panel including a plurality of display blocks; a driving circuit configured to control an image to be displayed on the display panel; and a timing controller configured to control the driving circuit in response to an image signal and a control signal and to provide a data signal to the driving circuit, wherein the timing controller comprises a memory storing gamma correction values corresponding to gray scales of the image signal, and wherein the timing controller outputs the data signal, and the data signal is obtained by correcting the image signal using the gamma correction values.

In some embodiments, the memory may include a plurality of lookup tables storing the gamma correction values, and wherein the timing controller may further include: a position determination unit configured to determine, based on the control signal, a position of the display block on which the image signal is to be displayed, and to output an index signal corresponding to the determined position of the display block; and a gamma correction unit configured to receive the index signal, to select the lookup table corresponding to the index signal, and to output the data signal, wherein the data signal may be obtained by correcting the image signal using the gamma correction values in the lookup table.

In some embodiments, a number of the lookup tables may be less than a number of the display blocks of the display panel.

In some embodiments, each of the lookup tables may include the gamma correction values of all gray scales of the image signal.

In some embodiments, each of the lookup tables may include gamma correction values of some gray scales of the image signal.

In some embodiments, the gamma correction unit may be further configured to calculate gamma correction values of gray scales not included in the lookup tables, by using the gamma correction values of the some gray scales, and wherein the gamma correction unit may output the data signal, and the data signal may be obtained by correcting the image signal using the gamma correction values of the some gray scales and the calculated gamma correction values.

In some embodiments, each of the display blocks may include i×j pixels (i and j each being a positive integer).

In some embodiments, each of the display blocks may include one pixel.

According to some other embodiments of the inventive concept, a method of driving a display apparatus is provided. The method includes: receiving an image signal and a control signal; selecting, based on the control signal, a lookup table from among a plurality of lookup tables, and storing a gamma correction value corresponding to a position on a display panel on which the image signal is to be displayed; and outputting a data signal, wherein the data signal is obtained by correcting the image signal using the selected lookup table.

In some embodiments of the method, selecting the lookup table may further include: receiving the control signal; determining, based on the control signal, the position on the display panel on which the image signal is to be displayed; outputting an index signal corresponding to the determined position; and selecting the lookup table corresponding to the index signal.

In some embodiments of the method, outputting the data signal may further include: reading the gamma correction value corresponding to a gray scale of the image signal from the selected lookup table; and outputting the data signal, wherein the data signal may be obtained by adding the image signal and the read gamma correction value.

In some embodiments of the method, the display panel may include a plurality of display blocks, and wherein selecting the lookup table may include: outputting the index signal corresponding to one of the plurality of display blocks; and selecting the lookup table corresponding to the index signal.

In some embodiments of the method, each of the display blocks may include i×j pixels (i and j each being a positive integer).

In some embodiments of the method, each of the display blocks may include one pixel.

In some embodiments of the method, a number of the lookup tables may be less than a number of the display blocks of the display panel.

In some embodiments of the method, each of the lookup tables may include gamma correction values of all gray scales of the image signal.

In some embodiments of the method, each of the lookup tables may include gamma correction values of some gray scales of the image signal.

In some embodiments of the method, outputting the data signal may further include: calculating gamma correction values of gray scales not included in the lookup tables, by using the gamma correction values of the some gray scales; and outputting the data signal, wherein the data signal may be obtained by correcting the image signal using the gamma correction values of the some gray scales and the calculated gamma correction values.

With the above embodiments of the inventive concept, the size of the memory for gamma correction of a display apparatus can be reduced. Also, the image quality of the display apparatus may be improved by gamma-correcting all gray scales.

BRIEF DESCRIPTION OF THE DRAWINGS

FIG. 4 is a schematic diagram illustrating the memory shown in FIG. 2 according to an embodiment of the inventive concept.

FIGS. 5A to 5C are schematic diagrams illustrating a memory according to other embodiments of the inventive concept.

DETAILED DESCRIPTION

Figure 1:
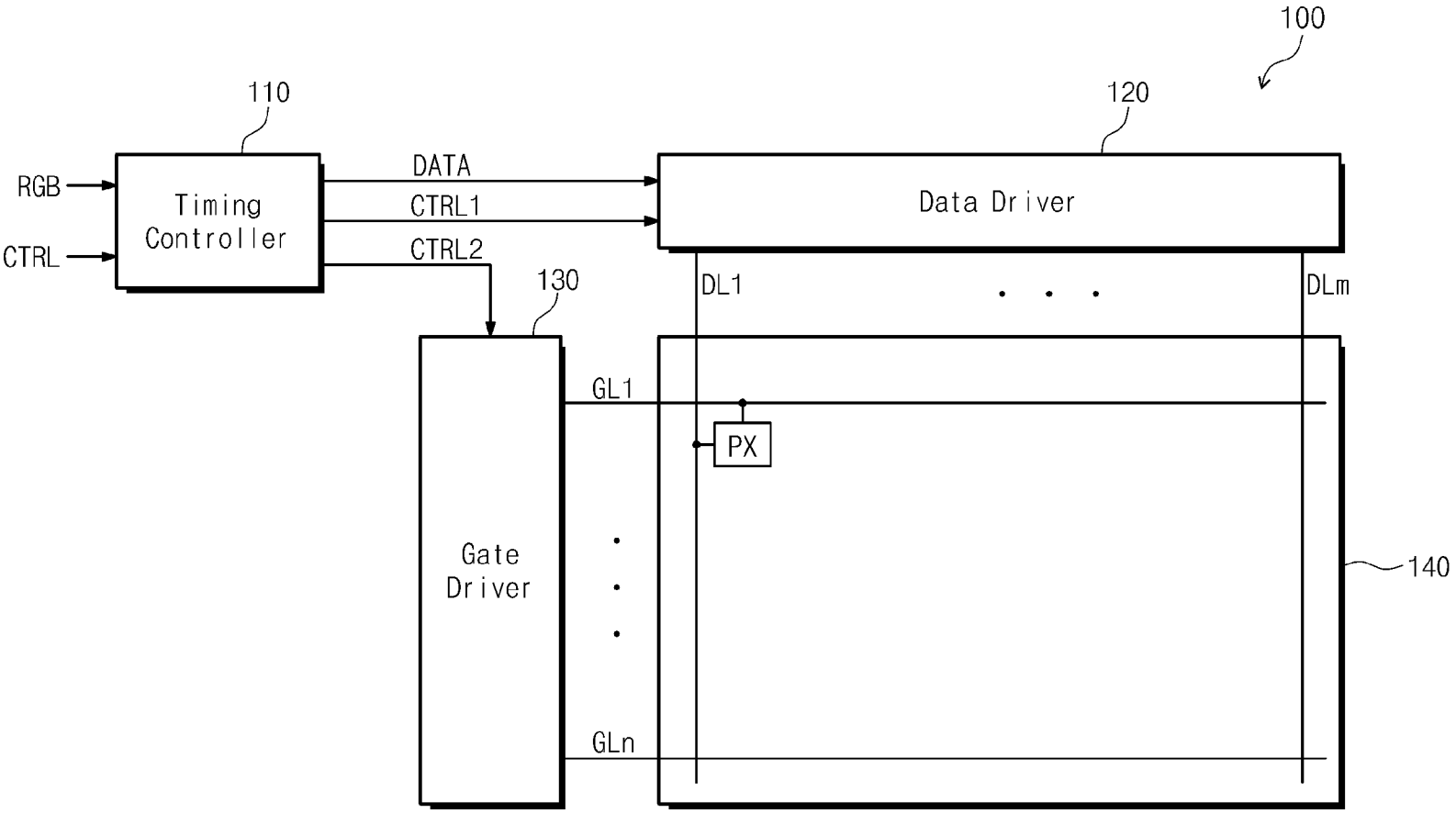
FIG. 1 is a block diagram schematically illustrating a display apparatus according to an embodiment of the inventive concept.

Embodiments of the inventive concept will be described in detail herein with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques may not be described with respect to some of the embodiments of the inventive concept. Unless otherwise noted, like reference numerals denote like elements throughout the attached drawings and written description, and thus their descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, the elements, components, regions, layers and/or sections should not be limited by these terms. These terms are only used to distinguish one element, component, region, layer or section from another region, layer or section. Thus, a "first" element, component, region, layer or section discussed below could be termed a "second" element, component, region, layer or section without departing from the teachings of the inventive concept.

Spatially relative terms, such as "beneath", "below", "lower", "under", "above", "upper" and the like, may be used herein for ease of description to describe one element or feature's spatial relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to limit the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or with one or more intervening elements or layers being present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

FIG. 1 is a block diagram schematically illustrating a display apparatus according to an embodiment of the inventive concept.

Referring to FIG. 1, a display apparatus 100 includes a timing controller 110, data driver 120, a gate driver 130, and a display panel 140.

The timing controller 110 receives a control signal CTRL and an image signal RGB from an external device. The image signal RGB may include red, green, and blue image signals RGB. The control signal CTRL may include a data enable signal, a horizontal synchronization signal, a vertical synchronization signal, and the like.

The timing controller 110 generates a data control signal CTRL1 and a gate control signal CTRL2 based on the control signal CTRL. The timing controller 110 performs gamma correction about the image signal RGB to output a data signal DATA. The operation of the timing controller 110 will be described in more detail with reference to FIG. 2.

A driving circuit of the display apparatus 100 includes the data driver 120 and the gate driver 130. The data driver 120 receives the data signal DATA and the data control signal CTRL1 from the timing controller 110, and outputs data line driving signals for driving data lines DL1 to DLm. The data control signal CTRL1 may include a horizontal start signal indicating a start of an operation of the data driver 120 and an output indication signal for determining when a data voltage is output from the data driver 120.

The gate driver 130 receives the gate control signal CTRL2 from the timing controller 110. The gate control signal CTRL2 may include a vertical start signal indicating a start of an operation of the gate driver 130, a gate clock signal for determining when a gate pulse is output, and an output enable signal for determining a width of a gate pulse. The gate driver 130 outputs gate driving signals for sequentially scanning gate lines GL1 to GLn of the display panel 140. Scanning may mean that a gate on voltage is sequentially applied to a gate line and that a pixel of the gate line supplied with the gate on voltage is writable.

The display panel 140 includes a plurality of data lines DL1 to DLm receiving data line driving signals from the data driver 120, a plurality of gate lines GL1 to GLn sequentially receiving a gate driving signal from the gate driver 130, and a plurality of pixels PX.

Figure 2:
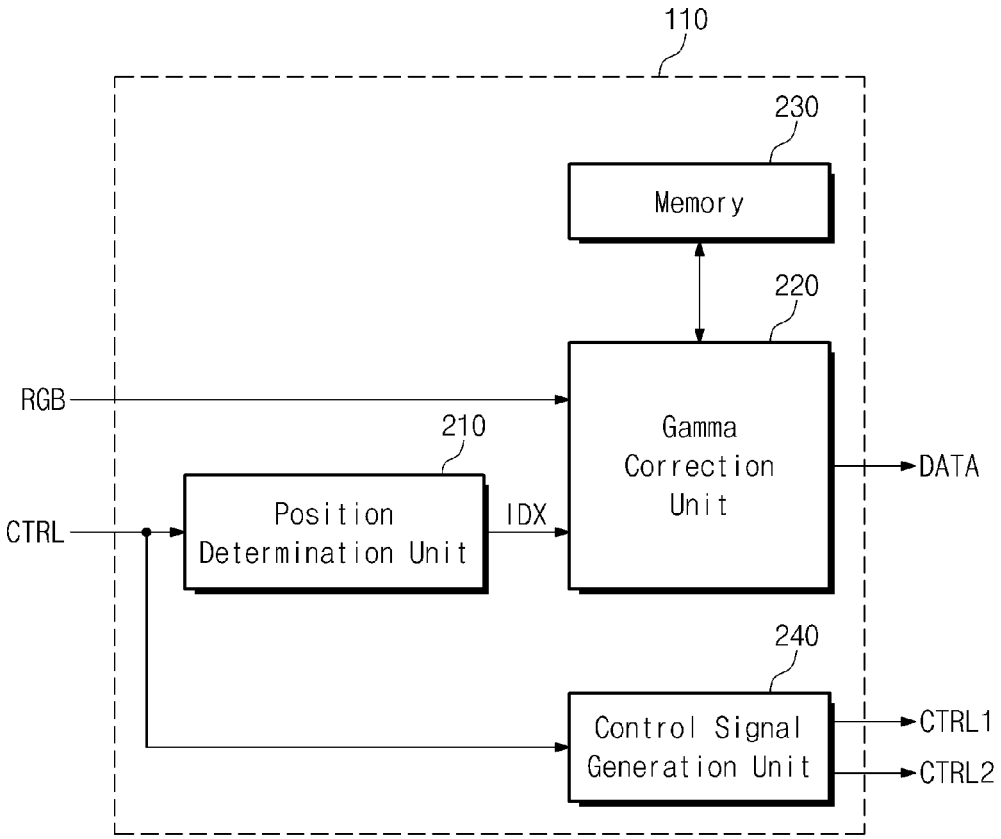
FIG. 2 is a block diagram schematically illustrating the timing controller shown in FIG. 1 according to an embodiment of the inventive concept.

FIG. 2 is a block diagram schematically illustrating the timing controller 110 shown in FIG. 1 according to an embodiment of the inventive concept.

Referring to FIG. 2, the timing controller 110 includes a position determination unit 210, a gamma correction unit 220, a memory 230, and a control signal generation unit 240.

The memory 230 may store a plurality of lookup tables including gamma correction values for gamma-correcting an image signal RGB.

The position determination unit 210 outputs an index signal IDX in response to a control signal CTRL. More particularly, the position determination unit 210 may determine a position on a display panel 140 (refer to FIG. 1) where a currently received image signal RGB is to be displayed, and output the index signal IDX corresponding to the determined position. The index signal IDX may be used to select one of a plurality of lookup tables stored in the memory 230.

The gamma correction unit 220 receives the index signal IDX from the position determination unit 210. The gamma correction unit 220 then selects one lookup table, corresponding to the index signal IDX, from among the plurality of lookup tables stored in the memory 230. The gamma correction unit 220 corrects the image signal RGB using a gamma correction value of the selected lookup table, and outputs a data signal DATA as the correction result.

The control signal generation unit 240 generates a data control signal CTRL1 to be provided to a data driver 120 (refer to FIG. 1) and a gate control signal CTRL2 to be provided to a gate driver 130 (refer to FIG. 1), based on the control signal CTRL.

Figure 3:
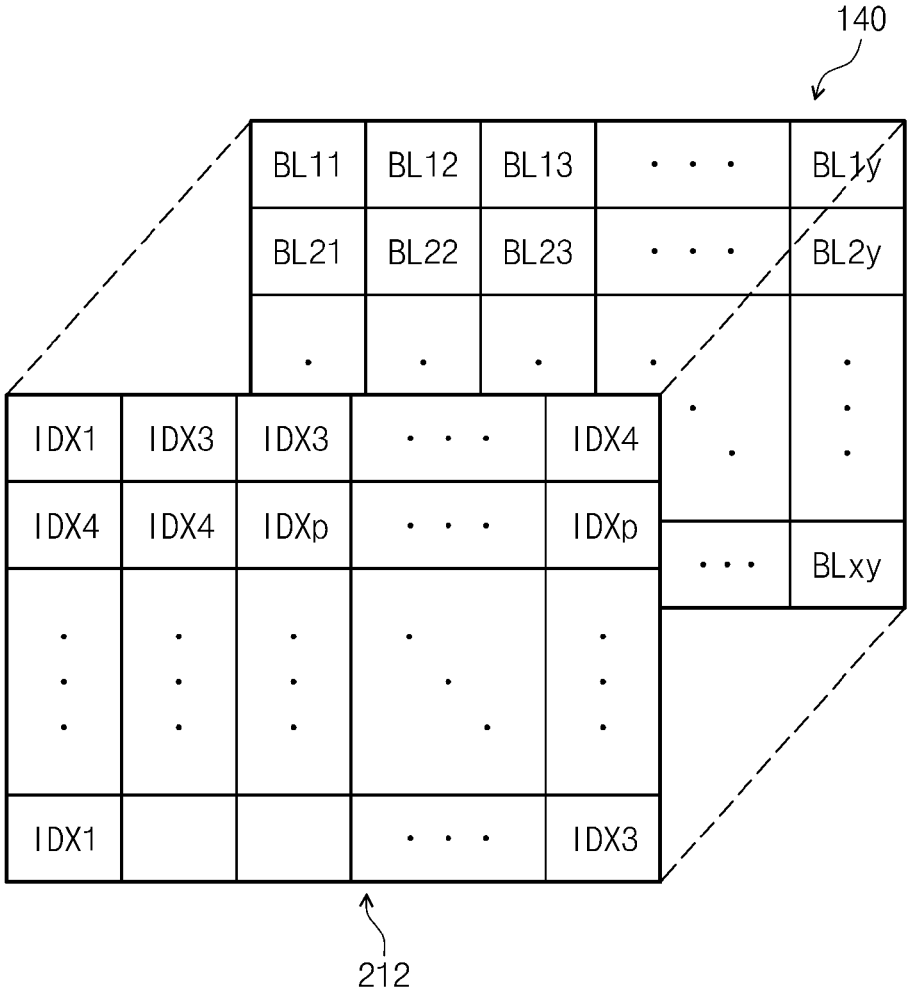
FIG. 3 is a diagram showing index signals corresponding to display blocks when the display panel shown in FIG. 1 is divided into display blocks.

FIG. 3 is a diagram showing index signals corresponding to display blocks when the display panel 140 shown in FIG. 1 is divided into display blocks.

Referring to FIGS. 2 and 3, the display panel 140 includes a plurality of display blocks BL11 to BLxy. Each of the display blocks BL11 to BLxy may include i×j pixels (i and j each being a positive integer) arranged in a matrix form. In other exemplary embodiments, each of the display blocks BL11 to BLxy may include a pixel.

A position determination unit 210 includes an index table 212 that stores index signals IDX1 to IDXp corresponding to the respective display blocks BL11 to BLxy.

The index table 212 may be stored in a specific area of the memory 230 or implemented by a separate memory.

Based on the control signal CTRL, the position determination unit 210 determines a position of a display block, on which a currently received image signal RGB is to be displayed, from among the display blocks BL11 to BLxy of the display panel 140. As previously described, the position determination unit 210 outputs an index signal IDX corresponding to the determined position.

For example, when the currently received image signal RGB is displayed on the display block BL21 of the display panel 140, the position determination unit 210 outputs an index signal "IDX4".

FIG. 4 is a schematic diagram illustrating the memory 230 shown in FIG. 2 according to an embodiment of the inventive concept.

Referring to FIGS. 2 and 4, the memory 230 includes a plurality of lookup tables LUT1 to LUTp. Each of the lookup tables LUT1 to LUTp stores gamma correction values corresponding to gray scales 300 of an image signal RGB.

Gamma correction values stored in the lookup tables LUT1 to LUTp may be different from one another. For example, when a gray scale of an input image signal RGB is "100", a gamma correction value GM1 of a lookup table LUT1 corresponding to the gray scale of "100" may be different from a gamma correction value GM2 of a lookup table LUT2 corresponding to the gray scale of "100".

When image signals RGB with the same gray scale are provided to the timing controller 110, the brightness of an image displayed on the display panel 140 (refer to FIG. 1) may be irregular. For example, a brightness of an area may be brighter or darker than a corresponding target brightness for that area. The lookup tables LUT1 to LUTp may include a first lookup table which stores gamma correction values for lowering a gray scale of an image signal RGB corresponding to a brighter area (compared with the brightness of the original expression), and a second lookup table which stores gamma correction values for increasing a gray scale of an image signal RGB corresponding to a darker area (compared with the brightness of the original the expression).

The gamma correction unit 220 selects one lookup table, corresponding to an index signal IDX, from among the lookup tables LUT1 to LUTp stored in the memory 230. For example, when an index signal IDX1 is received from the gamma correction unit 220, the gamma correction unit 220 selects the lookup table LUT1 corresponding to the index signal IDX1, from among the lookup tables LUT1 to LUTp.

When an index signal IDXp is received from the gamma correction unit 220, the gamma correction unit 220 selects one lookup table LUTp, corresponding to the index signal IDXp, from among the lookup tables LUT1 to LUTp stored in the memory 230. The gamma correction unit 220 may read a gamma correction value corresponding to a gray scale of an input image signal RGB from the selected lookup table LUTp. The gamma correction unit 220 then adds the gray scale of the input image signal RGB and the (read) gamma correction value to output a data signal DATA.

For example, when an index signal IDXp is received and a gray scale of an input image signal RGB is "100", the gamma correction unit 220 reads a gamma correction value GMp corresponding to the gray scale of "100" from the lookup table LUTp. The gamma correction unit 220 then adds the gray scale "100" of the input image signal RGB and the (read) gamma correction value GMp to output a data signal DATA to the data driving unit 120 (refer to FIG. 1).

The number of lookup tables LUT1 to LUTp may be determined according to a statistical numerical value. For example, an image signal RGB with a test pattern may be provided to the timing controller 110. The image signal RGB with the test pattern may have a value between a gray scale "0" and a gray scale "255", and may be provided to the timing controller 110 sequentially by one gray scale. A camera may sense brightness of each test image. Specifically, the camera may sense image brightness of respective display blocks BL11 to BLxy (refer to FIG. 3) of the display panel 140 (refer to FIG. 3).

Based on the sensed brightness, a test apparatus (not shown) may calculate an average brightness of the display blocks BL11 to BLxy at every gray scale. Reserved gamma correction values corresponding to a desired gamma curve may be determined based on the average brightness at every gray scale.

For example, a reserved gamma correction value may be determined based on a difference between a brightness value of a desired gamma curve at a gray scale "10" and an average brightness value that is measured when an image signal RGB with a test pattern of a gray scale "10" is received. Gamma correction values corresponding to the lookup tables LUT1 to LUTp may be determined by applying a statistical method to the reserved gamma correction value. A gamma correction value may be determined according to an average of the reserved gamma correction values of display blocks displaying similar brightness. A gamma correction value corresponding to each gray scale is then generated by averaging similar reserved gamma correction values, so as to build a lookup table.

The size of the memory 230 storing the lookup tables LUT1 to LUTp may be defined by the following: (the number of gray scales 300)×(the number p of lookup tables LUT1 to LUTp)×(a bit width of a gamma correction value). The number of gray scales 300 may be varied according to the usage application or purpose of the display apparatus 100. For example, an image signal RGB may have 64, 256, or 1024 gray scales. When a gamma correction value ranges from −127 to +127, the gamma correction value may have an 8-bit width.

When lookup tables for reversed gamma correction values are all generated, the number of lookup tables may be given by (x×y). That is, the number of lookup tables for reversed gamma correction values may be the same as the number of display blocks BL11 to BLxy (refer to FIG. 3). In exemplary embodiments. (x×y)>p. That is, the size of the memory 230 storing the lookup tables LUT1 to LUTp may be reduced when lookup tables are generated using gamma correction values generated by averaging similar reserved gamma correction values.

The memory 230 may be a nonvolatile memory such as an Electrically Erasable Programmable Read Only Memory (EEPROM) and the like.

FIGS. 5A to 5C are schematic diagrams illustrating a memory according to other embodiments of the inventive concept.

Referring to FIGS. 2 and 5A, each of a plurality of lookup tables LUT1 to LUTp stored in a memory 231 includes gamma correction values of some gray scales of an image signal RGB. For example, each of the lookup tables LUT1 to LUTp includes gamma correction values corresponding to gray scales 310 (nine gray scales including a gray scale "0" and a gray scale "255" out of all gray scales) of an image signal RGB.

The gamma correction unit 220 calculates gamma correction values of gray scales not stored in the memory 231, by interpolating gamma correction values of gray scales 310 stored in the memory 231. For example, the gamma correction unit 220 selects a lookup table LUT1 in response to an index signal IDX1 and an image signal RGB with a gray scale of "10". The gamma correction unit 220 reads a gamma correction value GMa of a gray scale of "0" and a gamma correction value GMb of a gray scale of "32" from the lookup table LUT1. The gamma correction unit 220 then interpolates the gamma correction value GMa of the gray scale of "0" and the gamma correction value GMb of the gray scale of "32", so as to calculate a gamma correction value of a gray scale of "10". A method of correcting an image signal through interpolations may include a linear interpolation method. However, the inventive concept is not limited thereto.

Referring to FIGS. 2 and 5B, each of a plurality of lookup tables LUT1 to LUTp stored in a memory 232 includes gamma correction values of some gray scales of an image signal RGB. For example, each of the lookup tables LUT1 to LUTp includes gamma correction values corresponding to gray scales 320 (seventeen gray scales including a gray scale "0" and a gray scale "255" out of all gray scales) of an image signal RGB.

Referring to FIGS. 2 and 5C, each of a plurality of lookup tables LUT1 to LUTp stored in a memory 233 includes gamma correction values of some gray scales of an image signal RGB. For example, each of the lookup tables LUT1 to LUTp includes gamma correction values corresponding to gray scales 330 (thirty-three gray scales including a gray scale "0" and a gray scale "255" out of all gray scales) of an image signal RGB.

The following Table 1 compares the sizes of memories between a comparison example and the different embodiments in FIGS. 4, 5A, 5B, and 5C.

TABLE 1

| Each of display blocks BL11 to BLxy includes 1 × 1 pixel | | |
|---|---|---|
| Memory size according to a comparison example (including lookup tables in which gamma correction values of nine gray scales are stored) | | 100% |
| Embodiments | Size of memory 231 in FIG. 5A | 12.5% |
| | Size of memory 232 in FiG. 5B | 12.5% |
| | Size of memory 233 in FIG. 5C | 12.6% |
| | Size of memory 230 in FIG. 4 | 13% |

Referring to the Table 1 and FIGS. 2, 4, and 5A to 5C, each of a plurality of display blocks BL11 to BLxy (refer to FIG. 3) may include one pixel.

In the comparison example, a memory may store lookup tables including gamma correction values of the plurality of display blocks BL11 to BLxy. For example, if the number of display blocks BL11 to BLxy is (x×y), the number of lookup tables may be (x×y).

Accordingly, a memory according to the comparison example may have a size given by: (the number of display blocks BL11 to BLxy×the number of gray scales×a bit width of a gamma correction value). The number of display blocks BL11 to BLxy may be large compared with other values. If each of the display blocks BL11 to BLxy includes one pixel and a display panel 140 (refer to FIG. 1) has a resolution of 1920×1080, the number of display blocks may be 2,073,600. The number of display blocks BL11 to BLxy may be greater than 256 (the number of gray scales). If the number of gray scales or a bit width of a gamma correction value increases slightly, the size of the memory may exponentially increase. In the comparison example, the memory may store lookup tables including gamma correction values of some gray scales of an image signal RGB to reduce the memory size. Referring to the comparison example in Table 1, a plurality of lookup tables including gamma correction values corresponding to nine gray scales of all gray scales of an image signal RGB may be stored in a memory (e.g. as illustrated in FIG. 5A). For comparison purposes, it may be assumed that the size of memory in the comparison example is 100%.

As previously described, in some exemplary embodiments of the inventive concept, a memory may store a plurality of lookup tables LUT1 to LUTp including gamma correction values obtained by averaging reserved gamma correction values of a plurality of display blocks BL11 to BLxy. In those embodiments, a size of the memory may be given by: (the number of display blocks BL11 to BLxy×the number of lookup table LUT1 to LUTp×(the number of gray scales×a bit width of a gamma correction value×the number p of lookup tables LUT1 to LUTp)). An equation relating to the size of memory may be an equation associated with an index table 212 (refer to FIG. 3), and is stored in any area of a memory in which lookup tables are stored.

The number of display blocks BL11 to BLxy may not be multiplied with a bit width of a gamma correction value or the number of gray scales. Although the number of gray scales or a bit width of a gamma correction value may increase, the increase has relatively little effect on the size of the memory of those other exemplary embodiments (compared with the comparison example).

In the embodiment shown in FIG. 5A, the size of memory 231 may be 12.5% of the size of the memory of the comparison example. In the embodiment shown in FIG. 5B, the size of memory 232 may be 12.5% of the size of the memory of the comparison example. In the embodiment shown in FIG. 5C, the size of memory 233 may be 12.6% of the size of the memory of the comparison example. In the embodiment shown in FIG. 4, the size of memory 233 may be 13% of the size of the memory of the comparison example. Thus, when compared with the comparison example, the size of the memory according to the different embodiments in FIGS. 4, 5A, 5B, and 5C may be reduced to about ⅛ the size of the memory of the comparison example.

According to an embodiment of the inventive concept, the size of memory 230 that stores lookup tables LUT1 to LUTp including gamma correction values corresponding to all gray scales 300 may be nearly similar to the size of memory 231 that stores lookup tables LUT1 to LUTp including gamma correction values of nine gray scales 310. An image signal RGB may be gamma corrected using lookup tables LUT1 to LUTp including gamma correction values corresponding to all gray scales, without increasing the size of the memory. As a result, an error due to gamma correction may be reduced, thereby improving the image quality of the display apparatus. Also, manufacturing costs may be reduced by decreasing the size of the memory. To further decrease the size of the memory, lookup tables LUT1 to LUTp including gamma correction values corresponding to some gray scales (e.g. those illustrated in FIGS. 5A to 5C) may be used.

Figure 6A:
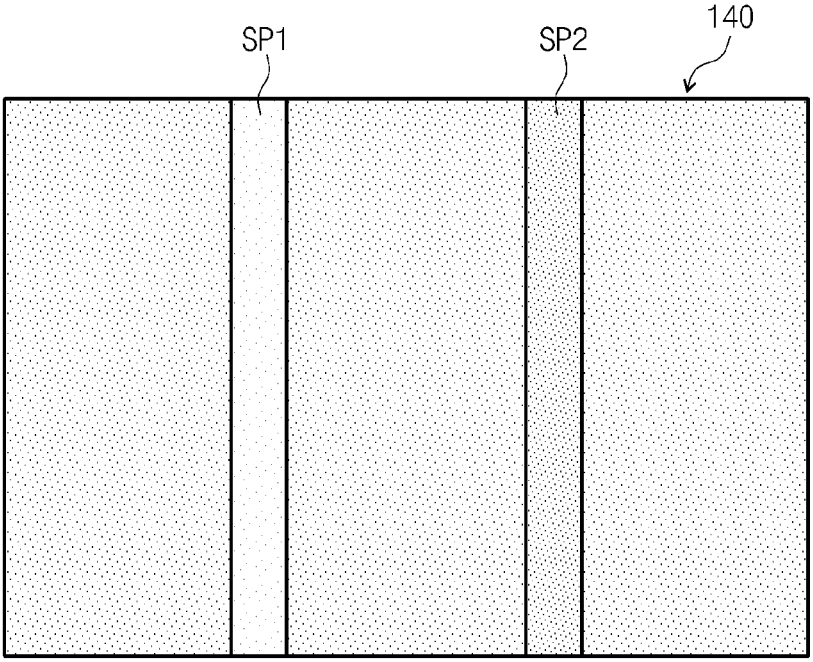
FIG. 6A is a plan view illustrating an example of spots on a display panel.

FIG. 6A is a plan view illustrating an example of spots on a display panel. Referring to FIG. 6A, brightness spots (in the form of vertical stripe patterns) may occur on a display panel 140 when an image signal RGB with a specific gray scale is provided to a timing controller 110.

Referring to FIGS. 2 and 6A, when image signals RGB with the same gray scale are displayed on the display panel 140, a first spot area SP1 having a higher brightness than another area may appear. If an image signal RGB corresponding to a position of the first spot area SP1 is received, a gamma correction unit 220 outputs a data signal DATA corrected to have a gray scale lower than a gray scale of the image signal RGB.

The first spot area SP1 may occur on display blocks BL16 to BLx6 (refer to FIG. 3). If a currently received image signal RGB corresponds to the play blocks BL16 to BLx6 in the display panel 140, a position determination unit 210 may output the same index signal IDX. For example, the position determination unit 210 may output an index signal IDX1.

When image signals RGB with the same gray scale are displayed on the display panel 140, a second spot area SP2 having lower brightness than another area may appear. If an image signal RGB corresponding to a position of the second spot area SP2 is received, the gamma correction unit 220 outputs a data signal DATA corrected to have a gray scale higher than a gray scale of the image signal RGB.

The second spot area SP2 may occur on display blocks BL19 to BLx9 (refer to FIG. 3). If a currently received image signal RGB corresponds to the play blocks BL19 to BLx9 in the display panel 140, the position determination unit 210 may output the same index signal IDX. For example, the position determination unit 210 may output an index signal IDX2.

When an image signal RGB corresponding to a position of a portion excluding the first and second spot areas SP1 and SP2 is provided to the display panel 140, the position determination unit 210 may output the same index signal IDX. For example, the position determination unit 210 may output an index signal IDX3.

Figure 6B:
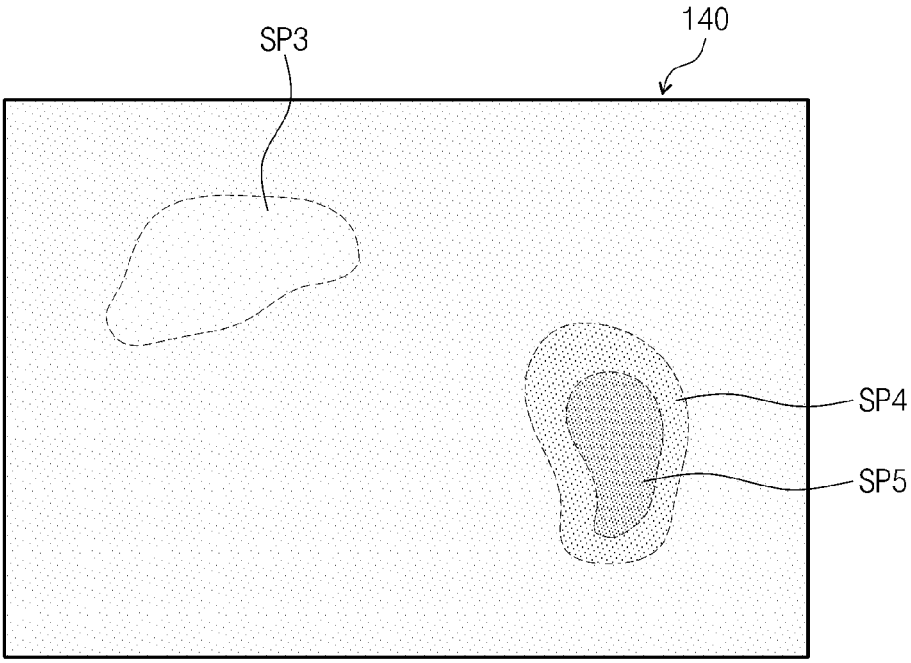
FIG. 6B is a plan view illustrating another example of spots on a display panel.

FIG. 6B is a plan view schematically illustrating another example of spots on a display panel. Referring to FIG. 6B, brightness spots (in the form of atypical/uneven patterns) may occur on a display panel 140 when an image signal RGB with a specific gray scale is provided to a timing controller 110.

Referring to FIGS. 2 and 6B, third to fifth spot areas SP3 to SP5 may occur on the display panel 140.

Index signals IDX stored in an index table 212 (refer to FIG. 3) and corresponding to display blocks in the third spot area SP3 may be equal to one another. For example, an index signal IDX may be "IDX1".

Index signals IDX stored in the index table 212 and corresponding to display blocks in the fifth spot area SP4 may be equal to one another. For example, an index signal IDX may be "IDX2". That is, each of display blocks in the fifth spot area SP4 may store one lookup table LUT2 (refer to FIG. 4) instead of separate lookup tables. Thus, the size of memory 230 may be reduced.

Figure 7:
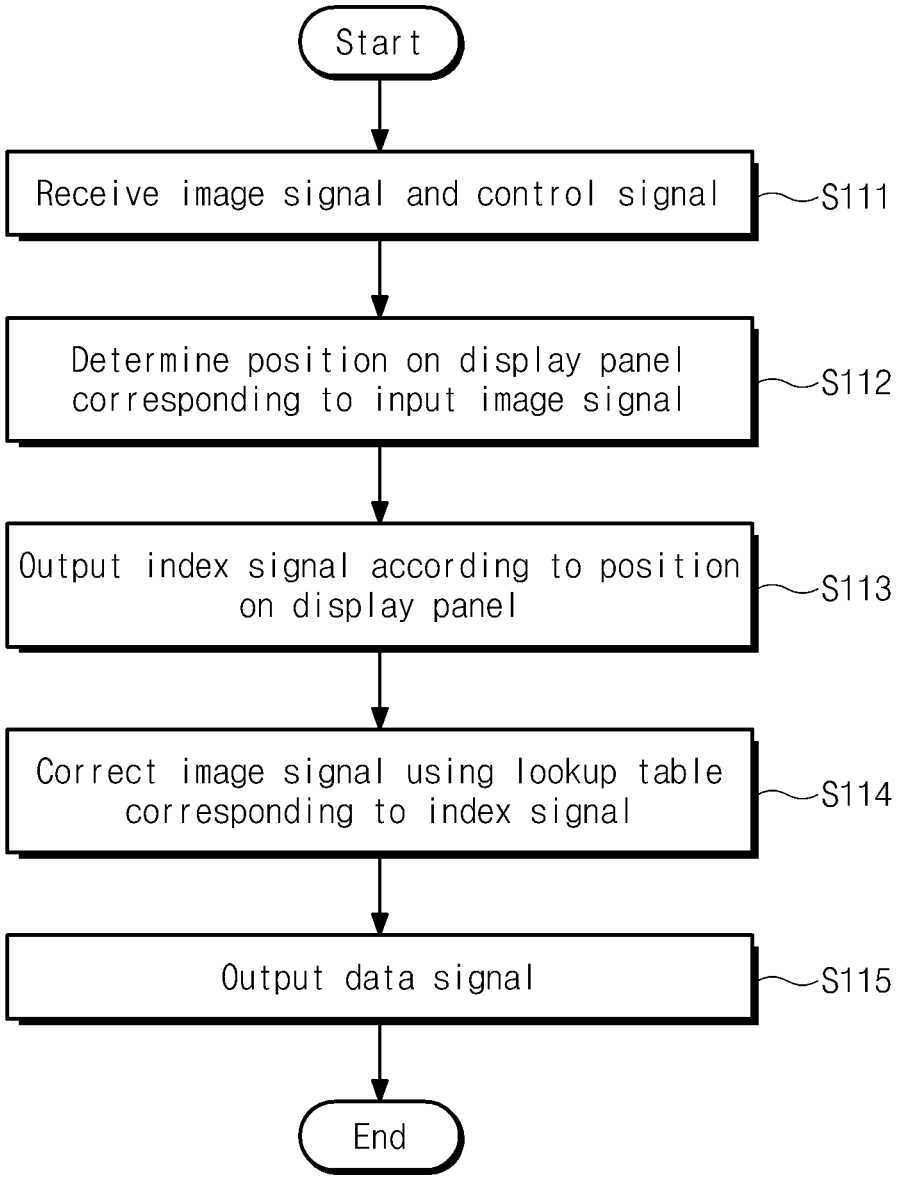
FIG. 7 is a flow chart illustrating a method of operating the timing controller shown in FIG. 2 according to an embodiment of the inventive concept.

FIG. 7 is a flow chart illustrating a method of operating the timing controller 110 shown in FIG. 2 according to an embodiment of the inventive concept.

Referring to FIGS. 2 and 7, in step S111, a timing controller 110 receives an image signal RGB and a control signal CTRL.

In step S112, a position determination unit 210 determines a position on a display panel 140 corresponding to the image signal RGB, based on the control signal CTRL. The display panel 140 may include a plurality of display blocks BL11 to BLxy (refer to FIG. 3). Specifically, the position determination unit 210 may determine whether the image signal RGB corresponds to any one of the display blocks BL11 to BLxy.

In step S113, the position determination unit 210 outputs an index signal IDX corresponding to the determined position. The position determination unit 210 may include an index table 212 (refer to FIG. 3) and may provide a gamma correction unit 220 with an index signal IDX corresponding to a display block on which the image signal RGB is to be displayed.

The gamma correction unit 220 receives the index signal IDX and then selects a lookup table, corresponding to the index signal IDX, from among a plurality of lookup tables LUT1 to LUTp (refer to FIG. 4) stored in a memory 230. The gamma correction unit 220 reads a gamma correction value corresponding to a gray scale of the image signal RGB from the selected lookup table. In step S114, the gamma correction unit 220 adds the image signal RGB and the (read) gamma correction value, and corrects the image signal RGB using lookup tables corresponding to the index signals. In step S115, the gamma correction unit 220 sequentially outputs a data signal DATA, wherein the data signal DATA is obtained by adding the image signal RGB and the (read) gamma correction value.

In other exemplary embodiments, as illustrated in FIGS. 5A to 5C, lookup tables LUT1 to LUTp may include some (but not all) gray scales of an image signal RGB. The gamma correction unit 220 may calculate gamma correction values of gray scales that are not stored, by interpolating gamma correction values of some gray scales. The gamma correction unit 220 may sequentially output a data signal DATA obtained by gamma-correcting the image signal RGB, using gamma correction values of some gray scales and gamma correction values calculated by interpolating gamma correction values of some gray scales.

Accordingly, the image quality of a display apparatus 100 may be improved by reducing brightness spots on the display panel 140 through gamma correction.

While the inventive concept has been described with reference to exemplary embodiments, it will be apparent to those skilled in the art that various changes and modifications may be made without departing from the spirit and scope of the inventive concept. Therefore, it should be understood that the above embodiments are not limiting, but are merely illustrative.

What is claimed is:

1. A display apparatus comprising:

a display panel including a plurality of display blocks;

a driving circuit configured to control an image to be displayed on the display panel; and a timing controller configured to control the driving circuit in response to an image signal and a control signal and to provide a data signal to the driving circuit, wherein the timing controller comprises a memory including a plurality of lookup tables storing gamma correction values corresponding to gray scales of the image signal and an index table storing index values, each of the plurality of display blocks is assigned with an index value based on a position on the display panel, and wherein the timing controller outputs the data signal, and the data signal is obtained by correcting the image signal using the gamma correction values stored in the plurality of lookup tables based on the index values corresponding to the plurality of display blocks.

2. The display apparatus of claim 1, wherein the timing controller further comprises:

a position determination unit configured to determine, based on the control signal, a position of a display block on which the image signal is to be displayed, and to output an index signal containing an index value based on the position of the display block; and a gamma correction unit configured to receive the index signal, to select a lookup table corresponding to the index signal, and to output the data signal, wherein the data signal is obtained by correcting the image signal using the gamma correction values in the lookup table.

3. The display apparatus of claim 2, wherein a number of the lookup tables is less than a number of the display blocks of the display panel.

4. The display apparatus of claim 3, wherein each of the lookup tables comprises the gamma correction values of all gray scales of the image signal.

5. The display apparatus of claim 3, wherein each of the lookup tables comprises gamma correction values of some gray scales of the image signal.

6. The display apparatus of claim 5, wherein the gamma correction unit is further configured to calculate gamma correction values of gray scales not included in the lookup tables, by using the gamma correction values of the some gray scales, and wherein the gamma correction unit outputs the data signal, and the data signal is obtained by correcting the image signal using the gamma correction values of the some gray scales and the calculated gamma correction values.

7. The display apparatus of claim 1, wherein each of the display blocks comprises i×j pixels (i and j each being a positive integer).

8. The display apparatus of claim 1, wherein each of the display blocks comprises one pixel.

9. A method of driving a display apparatus, the method comprising:

receiving an image signal and a control signal;

storing a plurality of lookup tables and an index table including index values corresponding to each of a plurality of display blocks, wherein each of the plurality of lookup tables includes gamma correction values corresponding to gray scales of the image signal;

selecting, based on the control signal and the index values, a lookup table from the plurality of lookup tables for each of the display blocks, and an index value corresponds to a position of a display block on a display panel on which the image signal is to be displayed;

outputting a data signal, wherein the data signal is obtained by correcting the image signal using the selected lookup table.

10. The method of claim 9, wherein selecting the lookup table further comprises:

receiving the control signal;

determining, based on the control signal, the position on the display panel on which the image signal is to be displayed;

outputting an index signal corresponding to the determined position; and selecting the lookup table corresponding to the index signal.

11. The method of claim 9, wherein outputting the data signal further comprises:

reading the gamma correction value corresponding to a gray scale of the image signal from the selected lookup table; and outputting the data signal, wherein the data signal is obtained by adding the image signal and the read gamma correction value.

12. The method of claim 9, wherein selecting the lookup table comprises:

outputting the index signal corresponding to one of the plurality of display blocks; and selecting the lookup table corresponding to the index signal.

13. The method of claim 12, wherein each of the display blocks comprises i×j pixels (i and j each being a positive integer).

14. The method of claim 12, wherein each of the display blocks comprises one pixel.

15. The method of claim 12, wherein a number of the lookup tables is less than a number of the display blocks of the display panel.

16. The method of claim 9, wherein each of the lookup tables comprises gamma correction values of all gray scales of the image signal.

17. The method of claim 9, wherein each of the lookup tables comprises gamma correction values of some gray scales of the image signal.

18. The method of claim 17, wherein outputting the data signal further comprises:

calculating gamma correction values of gray scales not included in the lookup tables, by using the gamma correction values of the some gray scales; and outputting the data signal, wherein the data signal is obtained by correcting the image signal using the gamma correction values of the some gray scales and the calculated gamma correction values.

* * * * *